US008833351B2

(12) United States Patent
Chen

(10) Patent No.: US 8,833,351 B2
(45) Date of Patent: Sep. 16, 2014

(54) STRIKING APPARATUS OF PAINTBALL GUN

(71) Applicant: Yi Tsong Chen, Tainan (TW)

(72) Inventor: Yi Tsong Chen, Tainan (TW)

(73) Assignee: Hsin-Cheng Yen, Tainan (TW)

( * ) Notice: Subject to any disclaimer, the term of this patent is extended or adjusted under 35 U.S.C. 154(b) by 0 days.

(21) Appl. No.: 13/745,564

(22) Filed: Jan. 18, 2013

(65) Prior Publication Data

US 2013/0186383 A1 Jul. 25, 2013

(30) Foreign Application Priority Data

Jan. 19, 2012 (TW) ..... 101201252 U

(51) Int. Cl.
*F41B 11/00* (2013.01)

(52) U.S. Cl.
USPC ..... 124/61; 124/70; 124/71; 124/73; 124/74; 124/75

(58) Field of Classification Search
USPC ..... 42/61, 70, 71, 73, 74, 75; 124/61, 70, 124/71, 73, 74, 75
See application file for complete search history.

(56) References Cited

U.S. PATENT DOCUMENTS

| | | | | |
|---|---|---|---|---|
| 5,634,456 | A * | 6/1997 | Perrone | 124/76 |
| 6,807,959 | B1 * | 10/2004 | Murdock et al. | 124/61 |
| 2006/0107938 | A1 * | 5/2006 | Rice | 124/73 |
| 2007/0113835 | A1 * | 5/2007 | Yeh | 124/73 |

* cited by examiner

*Primary Examiner* — J. Woodrow Eldred
(74) *Attorney, Agent, or Firm* — Perkins Coie LLP

(57) ABSTRACT

In one embodiment, a striking apparatus of a paintball gun is provided. The striking apparatus is received in a receiving chamber of a gun body. The gun body has a screw-jointing hole for being screwed and fixed to the striking apparatus. The striking apparatus includes a sleeve, a striking unit, a valve, and a pressure adjuster. The striking unit and the valve are received in the sleeve in sequence, and then the pressure adjuster is screwed to the sleeve. Being a unitary structure, the striking apparatus can be separated from the gun body completely and directly, and thus is easy to disassemble, maintain, and assemble.

16 Claims, 6 Drawing Sheets

STRIKING APPARATUS OF PAINTBALL GUN

CROSS-REFERENCE TO RELATED APPLICATIONS

This application claims the benefit of Taiwan Patent Application No. 101201252, filed Jan. 19, 2012, which is incorporated herein by reference.

BACKGROUND OF THE INVENTION

1. Technical Field

The present invention relates to striking apparatuses of paintball guns, and more particularly, to a striking apparatus which is a unitary structure that can be directly separated from a gun body and thus is easy to uninstall, maintain, and assemble, thereby incurring low costs.

2. Description of Related Art

Taiwan Patent application No. 098205918 entitled Structure of Gun Body of Paintball Gun Having High-pressure Regulator was filed with the Taiwan Intellectual Property Office by the inventor of the present invention on Apr. 10, 2010 and granted the patent M363578. M363578 discloses a gun body, a striking unit and a rear guiding rod, a pressure adjuster and a rear cover. The gun body has a hollow-core barrel. The striking unit and the rear guiding rod are disposed inside the hollow-core barrel in sequence. The pressure adjuster is disposed inside the gun body behind the rear guiding rod. The rear cover is screwed to the gun body. With the pressure adjuster being disposed inside the gun body, it is not necessary for the pressure adjuster to be connected to an external inlet tube, thereby preventing tube rupture, enhancing user safety, and having the following advantages:

1. It is not necessary for the pressure adjuster to be connected to an external inlet tube, thereby reducing assembly and connection parts and cutting costs.

2. The reduction of assembly and connection parts is accompanied by reduction of the chance that the parts will be loosened and disconnected.

3. Pressurized air is supplied by a pressurized air canister via an air passage inside the stock of the gun body and advantageously characterized by a short air injection journey and quick pressure boost.

However, in practice, the aforesaid structure has the following drawbacks:

1. An assembly process requires positioning the striking unit and the rear guiding rod in the hollow-core barrel in sequence, positioning the pressure adjuster inside the gun body behind the rear guiding rod, and screwing the rear cover to the gun body; in other words, the aforesaid parts have to be put together one by one, and the dimensions of the parts have to be precise, thereby incurring high costs.

2. The barrel of the gun body is long, and the parts have to be put together one by one; hence, there is no guarantee that the positioning of the parts is precise, nor can disassembly, maintenance, and assembly be performed easily and quickly.

SUMMARY OF THE INVENTION

Some embodiments of the present invention provide a striking apparatus of a paintball gun with a view to overcoming the aforesaid drawbacks of the prior art—parts have to be put together one by one, whereas disassembly, maintenance, and assembly cannot be performed easily and quickly.

Some embodiments of the present invention provide a striking apparatus of a paintball gun. The striking apparatus is received in a receiving chamber of a gun body. The gun body has a screw-jointing hole for being screwed and fixed to the striking apparatus. The striking apparatus comprises a sleeve, a striking unit, a valve, and a pressure adjuster.

The sleeve is a tapering hollow-core cylinder composed of two sections of different diameters and has a first coupling hole centrally disposed therein. The first coupling hole is inwardly formed with a stopping portion located at the junction of the two sections of different diameters. At least one first air-passing hole and a first screw hole are disposed in the circumferential wall of the larger (in diameter) one of the two sections. At least one vent is disposed in the circumferential wall of the smaller (in diameter) one of the two sections.

The striking unit corresponds in position to and is received in the sleeve. The striking unit has one end coupled to a guiding rod. The bottom of the guiding rod has a first aperture. A first airtight ring and a buffer ring are disposed around the circumferential wall of the striking unit.

The valve corresponds in position to and is received in the larger (in diameter) one of the two sections of the sleeve. The valve is centrally formed with a first receiving hole corresponding in position to the guiding rod of the striking unit. A second air-passing hole is formed in the circumferential wall of the valve and is in communication with the first receiving hole. A flange is disposed around the valve and corresponds in position to the stopping portion inwardly formed at the first coupling hole of the sleeve. Ventilation notches are formed on an end side of the valve. A second airtight ring is disposed inside the valve.

The pressure adjuster corresponds in position to the sleeve and is screwed thereto.

The pressure adjuster further comprises a screw-jointing rod, a piston, a spring element, and a pressure-adjusting bolt. The screw-jointing rod has a first screw-jointing portion corresponding in position to the screw-jointing hole of the gun body. A second receiving hole, a through hole, a second screw hole, and a pressure-adjusting hole are disposed inside the screw-jointing rod in sequence. The screw-jointing rod has a second aperture and a third aperture. The screw-jointing rod has a second screw-jointing portion corresponding in position to a first screw hole of the sleeve. The piston is received in the second receiving hole of the screw-jointing rod. The piston has an abutting portion corresponding in position to and abutting against the end side of the valve. The piston has an abutting face and an extending portion. The piston has therein a fourth aperture penetrating the piston. The spring element is received in the second receiving hole of the screw-jointing rod and abuts against the abutting face of the piston. The pressure-adjusting bolt has a third screw-jointing portion corresponding in position to the second screw hole of the screw-jointing rod, and has therein a stepped third receiving hole for penetration by the extending portion of the piston. The pressure-adjusting bolt has a position-limiting block. The pressure-adjusting bolt has a fifth aperture disposed on the third receiving hole and communicating with a second aperture of the screw-jointing rod.

Some embodiments of the present invention have the following advantages:

1. The striking apparatus is a unitary structure and thus can be separated from the gun body directly and completely, thereby facilitating the disassembly and maintenance of the striking apparatus.

2. Since the striking apparatus with all its parts connected in place has become a unitary structure, assembly thereof is very easy.

3. Due to the ease of disassembly, maintenance, and assembly, it is feasible to cut costs.

DETAILED DESCRIPTION OF THE EMBODIMENTS OF THE INVENTION

Figure 1:
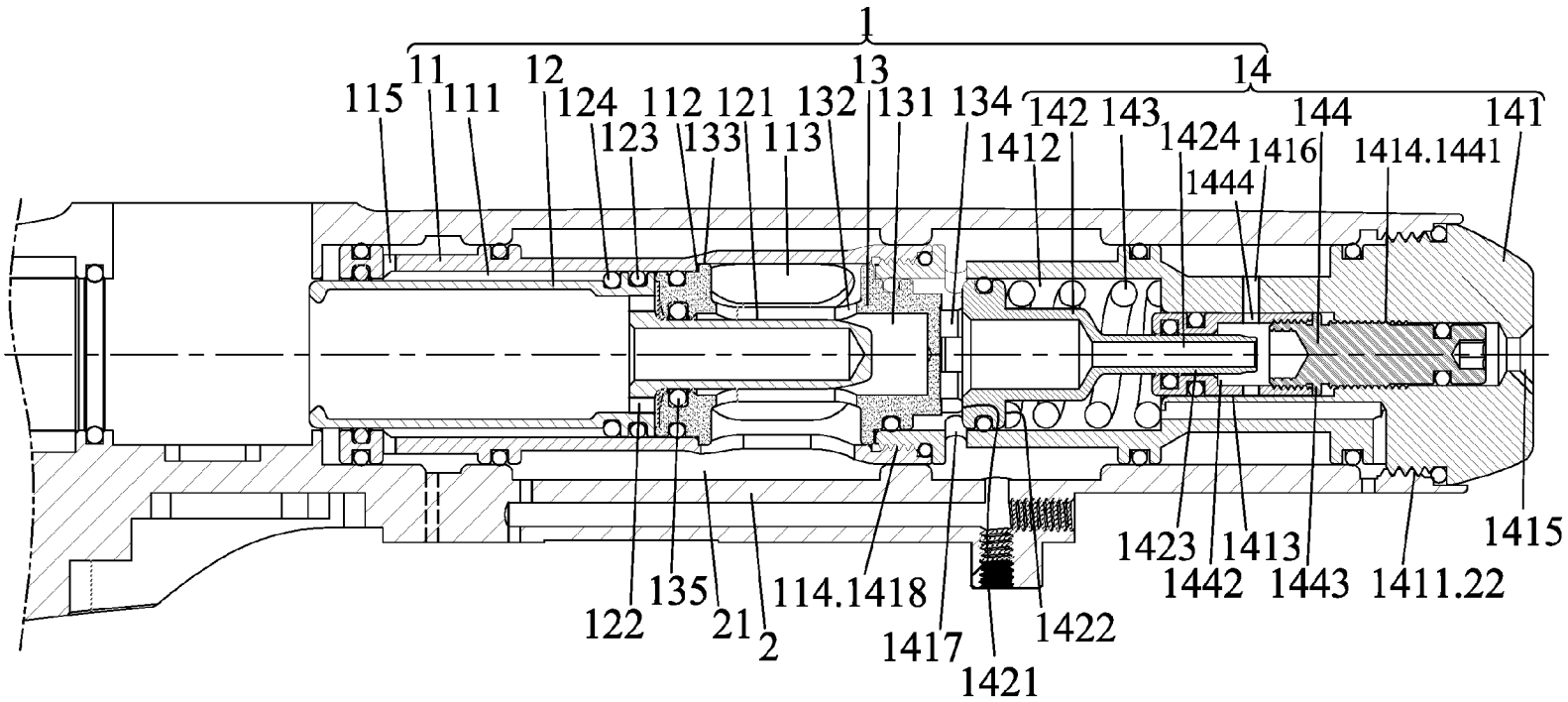
FIG. 1 is a schematic cross-sectional view of a striking apparatus for use with a gun body according to the present invention.
Figure 2:
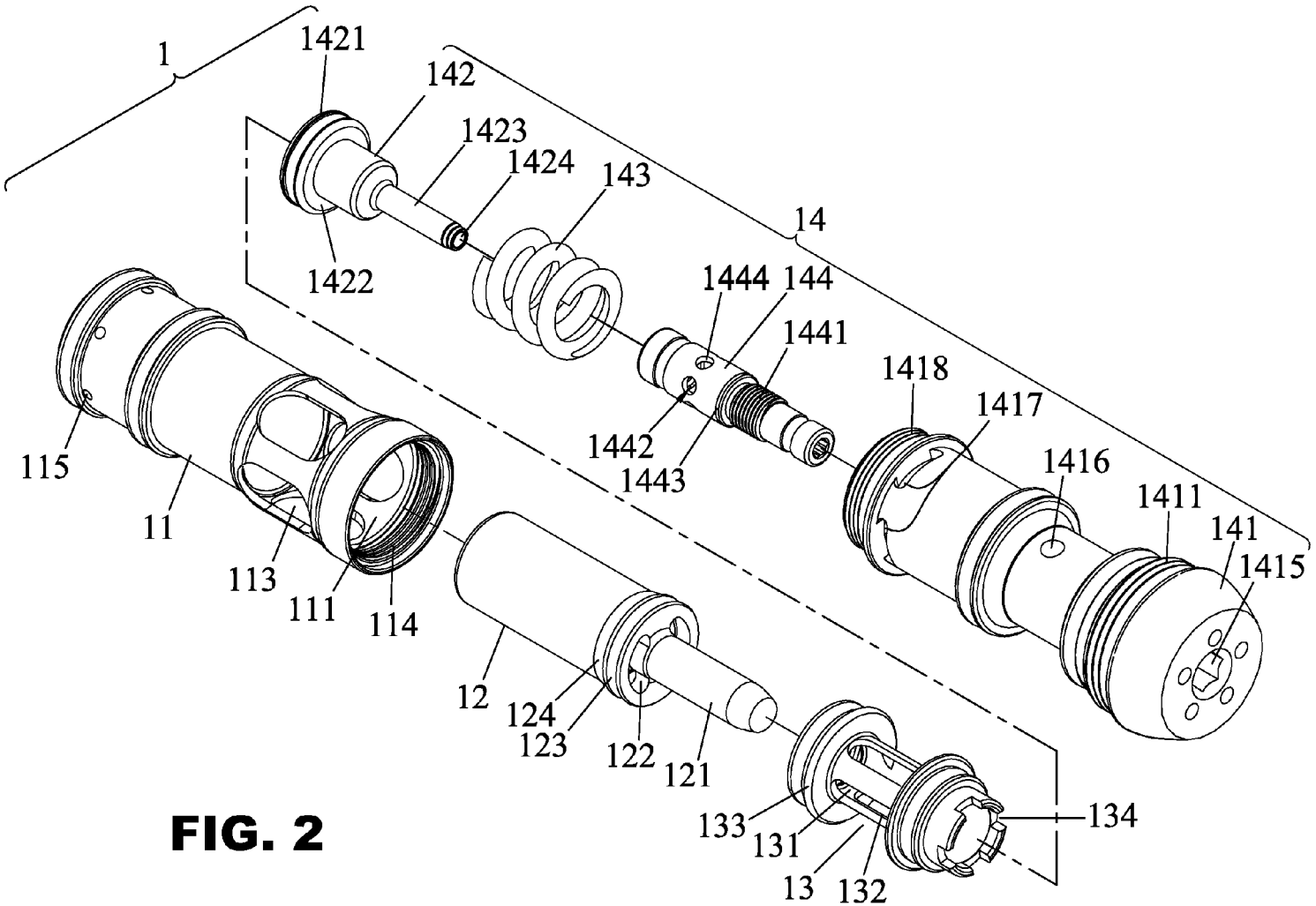
FIG. 2 is a schematic exploded view of the striking apparatus of the present invention.
Figure 3:
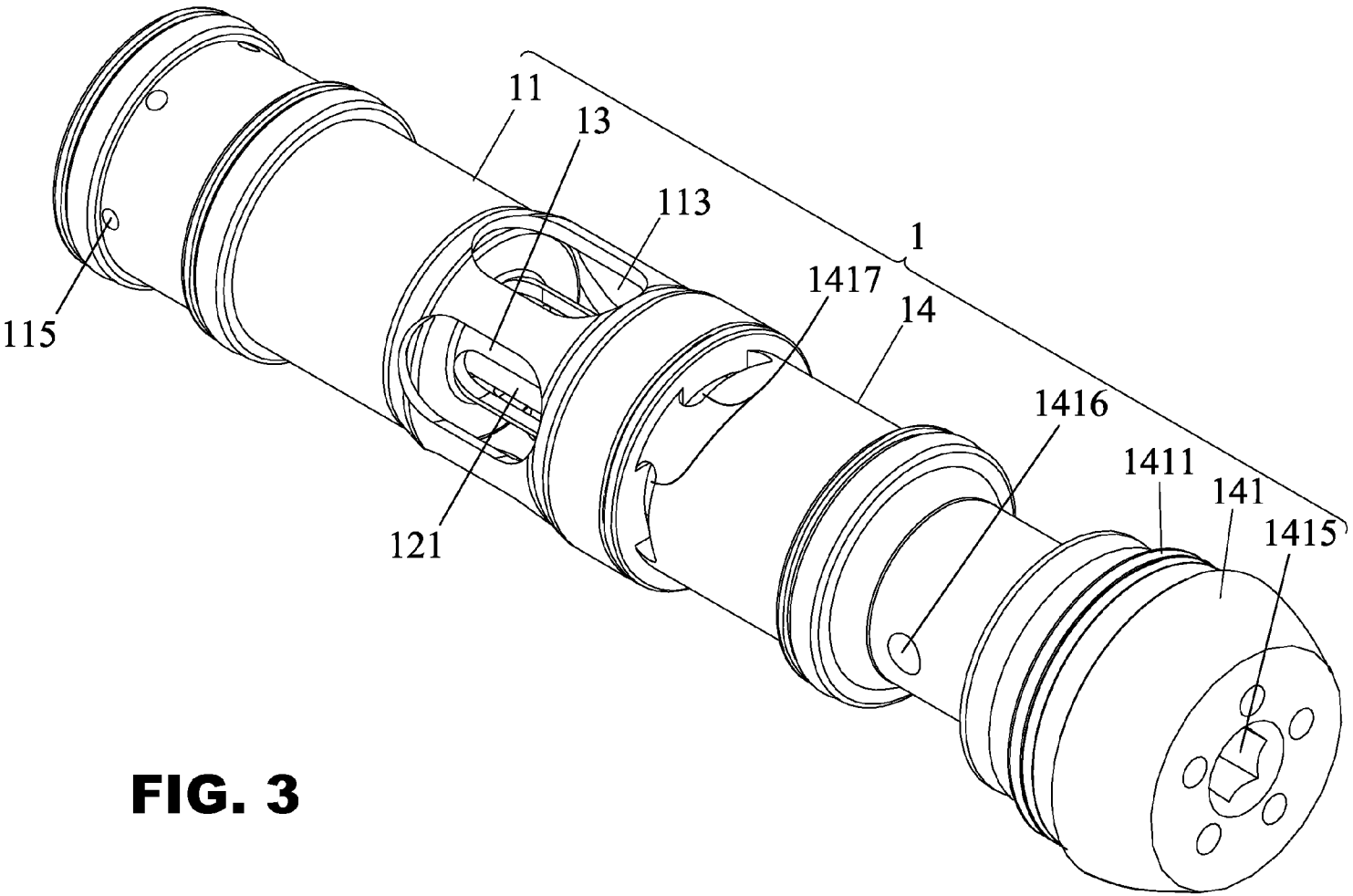
FIG. 3 is a schematic view of the assembled striking apparatus of the present invention.
Figure 4:
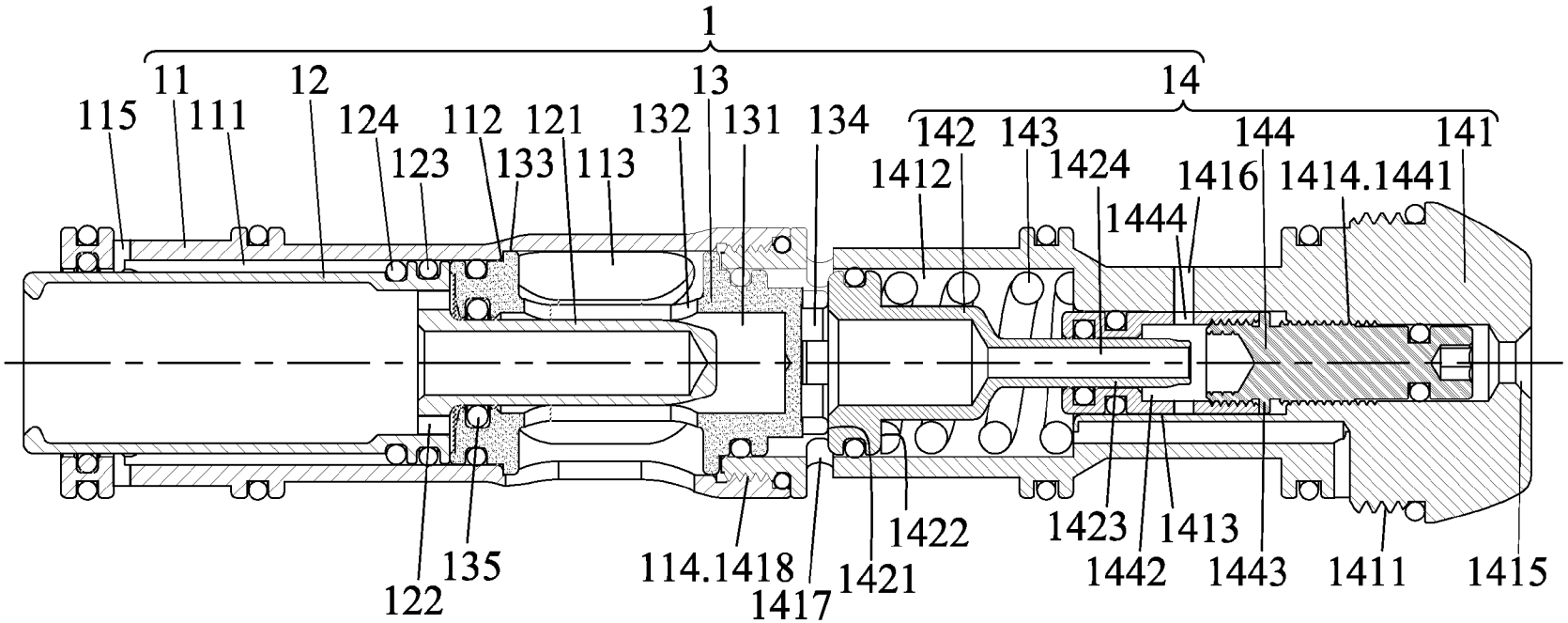
FIG. 4 is a schematic cross-sectional view of the striking apparatus of the present invention.

Referring to FIG. 2, FIG. 3, and FIG. 4, there are shown diagrams of a striking apparatus 1 for use with a paintball gun according to the present invention. The striking apparatus 1 is received in a receiving chamber 21 of a gun body 2. The gun body 2 has a screw-jointing hole 22 for being screwed and fixed to the striking apparatus 1 (see FIG. 1). The striking apparatus 1 comprises a sleeve 11, a striking unit 12, a valve 13, and a pressure adjuster 14.

The sleeve 11 is a tapering hollow-core cylinder that consists of two sections of different diameters and has a first coupling hole 111 centrally disposed therein. The first coupling hole 111 is inwardly formed with a stopping portion 112 located at the junction of the two sections of different diameters. At least one first air-passing hole 113 and a first screw hole 114 are disposed in the circumferential wall of the larger (in diameter) one of the two sections. At least one vent 115 is disposed in the circumferential wall of the smaller (in diameter) one of the two sections. Gas is discharged through the at least one vent 115 after the striking apparatus 1 has struck and restored.

The striking unit 12 corresponds in position to and is received in the sleeve 11. The striking unit 12 has one end coupled to a guiding rod 121. The bottom of the guiding rod 121 has a first aperture 122. A first airtight ring 123 and a buffer ring 124 are disposed around the circumferential wall of the striking unit 12.

The valve 13 corresponds in position to and is received in the larger (in diameter) one of the two sections of the sleeve 11. The valve 13 is centrally formed with a first receiving hole 131 corresponding in position to the guiding rod 121 of the striking unit 12. A second air-passing hole 132 is formed in the circumferential wall of the valve 13 and is in communication with the first receiving hole 131. A flange 133 is disposed around the valve 13 and corresponds in position to the stopping portion 112 inwardly formed at the first coupling hole 111 of the sleeve 11. Ventilation notches 134 spaced apart from each in a circle are formed on an end side of the valve 13. A second airtight ring 135 is disposed inside the valve 13.

The pressure adjuster 14 corresponds in position to and is screwed to the sleeve 11.

The pressure adjuster 14 further comprises a screw-jointing rod 141, a piston 142, a spring element 143, and a pressure-adjusting bolt 144.

The screw-jointing rod 141 has a first screw-jointing portion 1411 corresponding in position to the screw-jointing hole 22 of the gun body 2. A second receiving hole 1412, a through hole 1413, a second screw hole 1414 and a pressure-adjusting hole 1415 are disposed in the screw-jointing rod 141 in sequence. The screw-jointing rod 141 has a second aperture 1416 and a third aperture 1417. The screw-jointing rod 141 has a second screw-jointing portion 1418 corresponding in position to the first screw hole 114 of the sleeve 11.

The piston 142 is received in the second receiving hole 1412 of the screw-jointing rod 141. The piston 142 has an abutting portion 1421 corresponding in position to and abutting against the end side of the valve 13. The piston 142 has an abutting face 1422 and an extending portion 1423. The piston 142 has therein a fourth aperture 1424 penetrating the piston 142.

The spring element 143 is received in the second receiving hole 1412 of the screw-jointing rod 141 and abuts against the abutting face 1422 of the piston 142.

The pressure-adjusting bolt 144 has a third screw-jointing portion 1441 corresponding in position to the second screw hole 1414 of the screw-jointing rod 141, a stepped third receiving hole 1442 for penetration by the extending portion 1423 of the piston 142, a position-limiting block 1443 for limiting the screwing position of the pressure-adjusting bolt 144 so as to control gas pressure, and a fifth aperture 1444 disposed on the third receiving hole 1442 and communicating with the second aperture 1416 of the screw-jointing rod 141. Pressure adjustment can be performed by hand on the pressure-adjusting bolt 144, using the pressure-adjusting hole 1415 of the screw-jointing rod 141.

Referring to FIG. 2, FIG. 3, and FIG. 4, an assembly process of the striking apparatus 1 of the present invention involves: screwing the third screw-jointing portion 1441 of the pressure-adjusting bolt 144 to the second screw hole 1414 of the screw-jointing rod 141; inserting the spring element 143 and the piston 142 in sequence; passing the extending portion 1423 of the piston 142 through the third receiving hole 1442 of the pressure-adjusting bolt 144 to form a pressure adjuster 14; positioning the striking unit 12 and the valve 13 in sequence in the sleeve 11, such that the guiding rod 121 of the striking unit 12 is received in the first receiving hole 131 of the valve 13; and screwing the second screw-jointing portion 1418 of the screw-jointing rod 141 of the pressure adjuster 14 to the first screw hole 114 of the sleeve 11.

Figure 5:
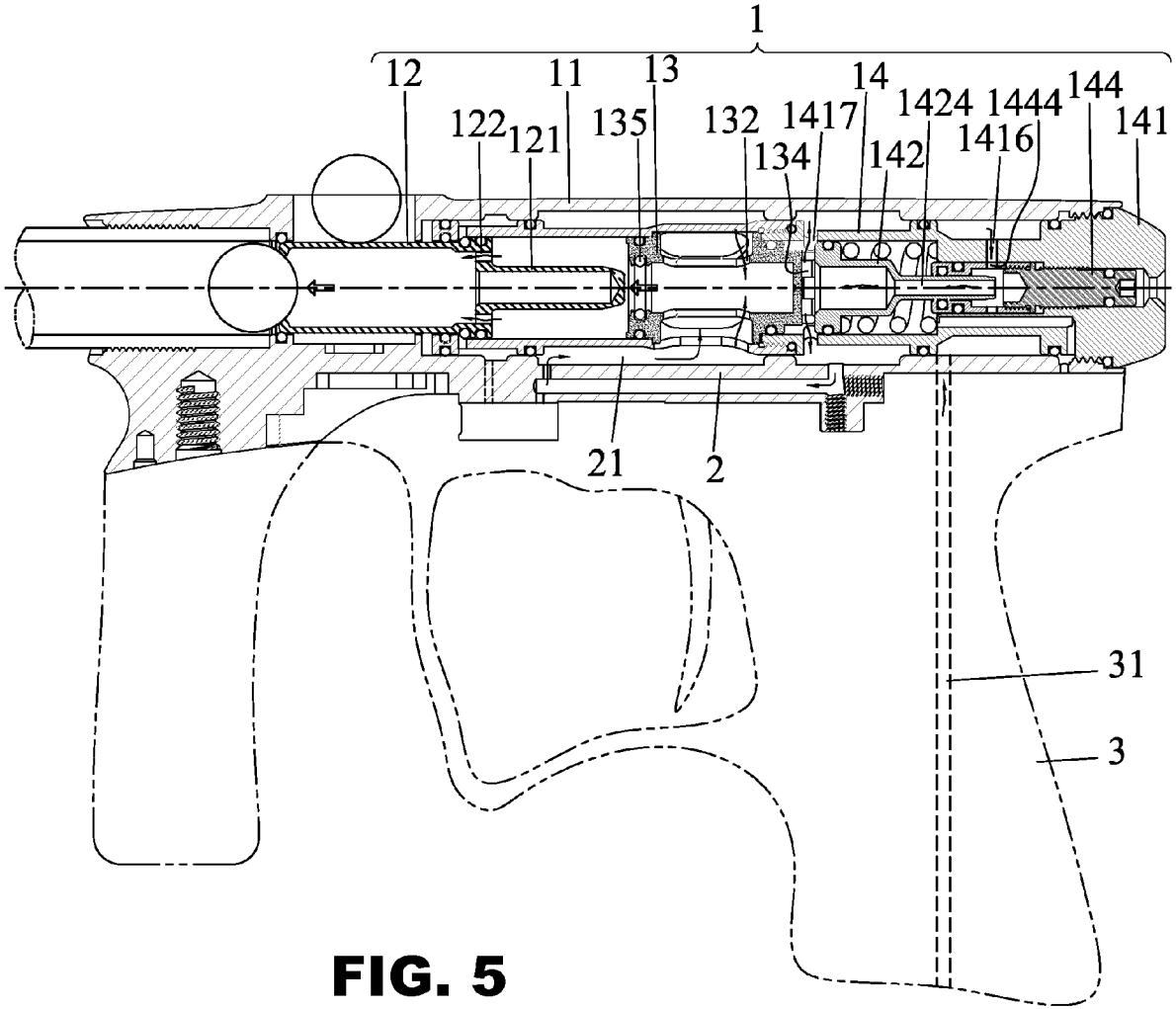
FIG. 5 is a schematic view of gas flow caused by a strike made by the striking apparatus operating in conjunction with the gun body and a stock according to present invention.

Referring to FIG. 5, the striking apparatus 1 strikes in conjunction with the gun body and a stock according to the present invention. The striking apparatus 1 is screwed and fixed to the gun body 2 and a stock 3. The stock 3 has therein an air passage 31. To starts a strike, gas is emitted from the stock 3 via an air passage 31 thereof, goes from the second aperture 1416 of the screw-jointing rod 141 to the fifth aperture 1444 of the pressure-adjusting bolt 144, enters the fourth aperture 1424 inside the piston 142, exits the third aperture 1417 of the screw-jointing rod 141 (wherein the third aperture 1417 is in communication with the ventilation notches 134 spaced apart in a circle and disposed on the end side of the valve 13), passes through the flow channel of the gun body 2 to enter the second air-passing hole 132 on the circumferential wall of the valve 13, such that the striking unit 12 is pushed by high-pressure gas. After the guiding rod 121 of the striking unit 12 has slided away from the second airtight ring 135 of the valve 13, a gap is formed. The high-pressure gas is delivered to the first aperture 122 at the bottom of the striking unit 12 and emitted therefrom, thereby achieving the pushing and projection effect.

Figure 6:
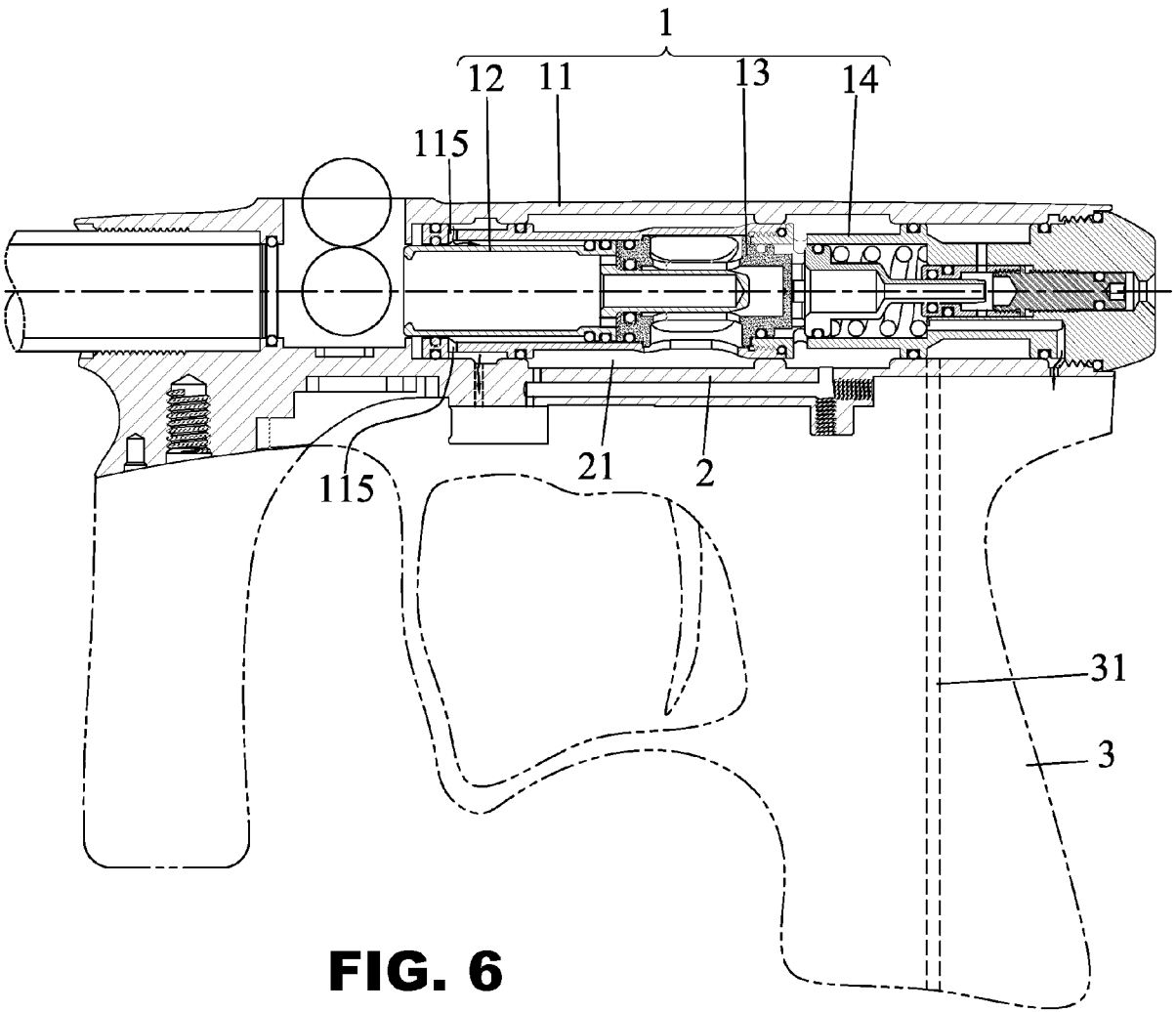
FIG. 6 is a schematic view of gas discharge caused by a strike made by the striking apparatus operating in conjunction with the gun body and the stock according to present invention.

Referring to FIG. 6, after the striking apparatus 1 has struck in conjunction with the gun body and the stock, and then the striking unit 12 of the striking apparatus 1 has restored, gas is discharged through the at least one vent 115 in the circumferential wall of the sleeve 11.

The present invention is disclosed above by preferred embodiments. However, persons skilled in the art should understand that the preferred embodiments are illustrative of the present invention only, but should not be interpreted as restrictive of the scope of the present invention. Hence, all re-inventions based on an invention principle and a technical means related to the present invention should fall within the scope of the present invention. Therefore, the disclosure contained in the specification and drawings of the present invention is not restrictive of the scope of the implementation of the present invention. All equivalent changes and modifications made by persons skilled in the art to the foregoing embodiments without departing from the spirit and scope of the present invention should fall within the scope of the present invention as set forth in the appended claims.

What is claimed is:

1. A striking apparatus of a paintball gun, the striking apparatus being received in a receiving chamber of a gun body, the gun body having a screw-jointing hole and screwed to the striking apparatus, the striking apparatus comprising:

a sleeve being a tapering hollow-core cylinder with a first and second section of different diameters, having a first coupling hole centrally disposed therein for coupling the hollow-core cylinder of the first section with the hollow-core cylinder of the second section, having a stopping portion inwardly formed on the first coupling hole and at a junction of the two sections, wherein at least one first air-passing hole and a first screw hole are disposed in a circumferential wall of the larger section of the sleeve, wherein at least one vent is disposed in the circumferential wall of the smaller section of the sleeve;

a striking unit corresponding in position to and received in the sleeve, the striking unit having one end coupled to a guiding rod, wherein a bottom of the guiding rod has a first aperture, wherein a first airtight ring and a buffer ring are disposed around a circumferential wall of the striking unit;

a valve corresponding in position to and received in the larger section of the sleeve, the valve being centrally formed with a first receiving hole corresponding in position to the guiding rod of the striking unit, wherein a second air-passing hole is formed in the circumferential wall of the valve and communicates with the first receiving hole, wherein a flange is disposed around the valve and corresponds in position to the stopping portion inwardly formed at the first coupling hole of the sleeve, wherein ventilation notches are formed on an end side of the valve, wherein a second airtight ring is disposed inside the valve; and a pressure adjuster corresponding in position to and screwed to the sleeve.

2. The striking apparatus of claim 1, wherein the pressure adjuster further comprises a screw-jointing rod, a piston, a spring element, and a pressure-adjusting bolt, the screw-jointing rod having a first screw-jointing portion corresponding in position to the screw-jointing hole of the gun body, the screw-jointing rod having therein a second receiving hole, a through hole, a second screw hole and a pressure-adjusting hole which are positioned in sequence, the screw-jointing rod having a second aperture and a third aperture, the screw-jointing rod having a second screw-jointing portion corresponding in position to a first screw hole of the sleeve, the piston being received in the second receiving hole of the screw-jointing rod, the piston having an abutting portion corresponding in position to and abutting against the end side of the valve, the piston having an abutting face and an extending portion, the piston having therein a fourth aperture penetrating the piston, the spring element being received in the second receiving hole of the screw-jointing rod and abutting against the abutting face of the piston, and the pressure-adjusting bolt having a third screw-jointing portion corresponding in position to the second screw hole of the screw-jointing rod, a stepped third receiving hole for penetration by the extending portion of the piston, a position-limiting block, and a fifth aperture disposed on the third receiving hole and communicating with a second aperture of the screw-jointing rod.

3. A striking apparatus of a paintball gun comprising:

a sleeve comprising a first section and a second section wherein the first section has a larger diameter than the second section, a first hole disposed on the sleeve, a stopping portion formed by a ridge between the first and second sections of the sleeve, a first air-passing hole, a first screw hole, and a vent, wherein a first air-passing hole and a first screw hole are both disposed in a circumferential wall of the first section of the sleeve and wherein the vent is disposed in the circumferential wall of the second section of the sleeve;

a striking unit configured to be received by the sleeve, the striking unit comprising a guiding rod;

a valve configured to be received by the first section of the sleeve, the valve comprising a first receiving hole configure to receive the guiding rod of the striking unit, wherein the striking apparatus is configured to be received in a receiving chamber of a gun body.

4. The striking apparatus of claim 3 wherein the first coupling hole is centrally disposed on the sleeve.

5. The striking apparatus of claim 3 wherein the stopping portion is inwardly formed on the first coupling hole and at a junction of the first and second sections.

6. The striking apparatus of claim 3 further comprising a first airtight ring and a buffer ring disposed around a circumferential wall of the striking unit, wherein the striking unit further comprises a first end coupled to the guiding rod, and the guiding rod comprising a first aperture.

7. The striking apparatus of claim 3 wherein the valve comprises a second air-passing hole and a first receiving hole in communication, a flange disposed around the valve and corresponding in position to the stopping portion, ventilation notches formed on an end side of the valve, a second airtight ring is disposed inside the valve.

8. The striking apparatus of claim 3 further comprising a pressure adjuster.

9. The striking apparatus of claim 8 wherein the pressure adjusted is configured to attach to sleeve.

10. The striking apparatus of claim 3 wherein the gun body comprises a screw-jointing hole for receiving an attachment screw from the striking apparatus.

11. A striking apparatus of a paintball gun comprising:

a sleeve comprising a first section and a second section wherein the first section has a larger diameter than the second section, a first coupling hole disposed on the sleeve, a stopping portion formed by a ridge between the first and second sections of the sleeve, a first air-passing hole, a first screw hole, and a vent, wherein a first air-passing hole and a first screw hole are both disposed in a circumferential wall of the first section of the sleeve and wherein the vent is disposed in the circumferential wall of the second section of the sleeve;

a striking unit configured to be received by the sleeve, the striking unit comprising a guiding rod;

a valve configured to be received by the first section of the sleeve, the valve comprising a first receiving hole configure to receive the guiding rod of the striking unit; and a pressure adjuster configured to attach to sleeve, wherein the striking apparatus is configured to be received in a receiving chamber of a gun body and the gun body comprises a screw-jointing hole for receiving an attachment screw from the striking apparatus.

12. The striking apparatus of claim 11 wherein the first coupling hole is centrally disposed on the sleeve.

13. The striking apparatus of claim 11 wherein the stopping portion is inwardly formed on the first coupling hole and at a junction of the first and second sections.

14. The striking apparatus of claim 11 further comprising a first airtight ring and a buffer ring disposed around a circumferential wall of the striking unit, wherein the striking unit further comprises a first end coupled to the guiding rod, and the guiding rod comprising a first aperture.

15. The striking apparatus of claim 11 wherein the valve comprises a second air-passing hole and a first receiving hole in communication, a flange disposed around the valve and corresponding in position to the stopping portion, ventilation notches formed on an end side of the valve, a second airtight ring is disposed inside the valve.

16. The striking apparatus of claim 11, wherein the pressure adjuster further comprises a screw-jointing rod, a piston, a spring element, and a pressure-adjusting bolt.

* * * * *